US009397450B1

(12) United States Patent
Feng et al.

(10) Patent No.: US 9,397,450 B1
(45) Date of Patent: Jul. 19, 2016

(54) ELECTRICAL CONNECTOR WITH PORT LIGHT INDICATOR

(71) Applicants: Justin Feng, DongGuan (CN); Lawrence Chi-Yuen Chan, Shenzhen (CN); Adrian Green, Ontario (CA)

(72) Inventors: Justin Feng, DongGuan (CN); Lawrence Chi-Yuen Chan, Shenzhen (CN); Adrian Green, Ontario (CA)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 14/738,106

(22) Filed: Jun. 12, 2015

(51) Int. Cl.

| | |
|---|---|
| ***H01R 13/71*** | (2006.01) |
| ***H01R 13/717*** | (2006.01) |
| ***H01R 13/66*** | (2006.01) |
| ***H01R 13/6581*** | (2011.01) |

(52) U.S. Cl.
CPC ..... *H01R 13/7175* (2013.01); *H01R 13/6581* (2013.01); *H01R 13/665* (2013.01)

(58) Field of Classification Search
CPC .. H01R 13/7172; H01R 13/717; H01R 24/64; H01R 13/6658
See application file for complete search history.

(56) References Cited

U.S. PATENT DOCUMENTS

| | | | | | |
|---|---|---|---|---|---|
| 5,531,612 | A * | 7/1996 | Goodall | H01R 13/518 | 439/541.5 |
| 5,562,507 | A * | 10/1996 | Kan | H01R 31/02 | 439/676 |
| 5,639,267 | A * | 6/1997 | Loudermilk | H01R 13/518 | 439/607.27 |
| 5,741,152 | A * | 4/1998 | Boutros | H01R 13/717 | 439/490 |
| 5,876,239 | A * | 3/1999 | Morin | H01R 13/717 | 439/490 |

(Continued)

*Primary Examiner* — Ross Gushi
(74) *Attorney, Agent, or Firm* — Blank Rome LLP; Charles R. Wolfe, Jr.; Tara L. Marcus

(57) ABSTRACT

An electrical connector that includes a housing that has an interface side and a printed circuit board engagement side, and a port at said interface side. The port is adapted to receive a mating connector. The port includes a signal contact connected to an internal circuit board. The signal contact is configured to mate with a corresponding contact of the mating connector. The internal circuit board has at least one terminal with a tail end extending though the circuit board engagement side of said housing. A port light indicator is adjacent the port and has a light element facing outwardly and a terminal end. A spring element is received in the housing and has a contact end and an opposite press-fit end. The contact end is biased against the indicator terminal end and the press-fit end extends through the circuit board engagement side of the housing.

20 Claims, 3 Drawing Sheets

(56) References Cited

U.S. PATENT DOCUMENTS 5,876,240 A * 3/1999 Derstine ..... H01R 13/7175 340/815.47
5,924,890 A * 7/1999 Morin ..... H01R 13/641 439/490
6,068,520 A * 5/2000 Winings ..... H01R 24/64 439/540.1
6,080,011 A * 6/2000 Tsao ..... H01R 13/514 439/540.1
6,120,318 A * 9/2000 Reed ..... H01R 13/6691 439/490
6,193,560 B1 * 2/2001 Morana ..... H01R 12/716 439/541.5
6,206,725 B1 * 3/2001 Wu ..... H01R 13/514 439/541.5
6,210,237 B1 * 4/2001 Chang ..... H01R 13/506 439/607.28
6,227,911 B1 * 5/2001 Boutros ..... H01R 13/719 439/490
6,250,964 B1 * 6/2001 Fair ..... H01R 13/6467 439/439
6,299,480 B1 * 10/2001 Xu ..... H01R 13/659 439/607.26
6,352,446 B2 * 3/2002 Ezawa ..... H01R 13/659 439/490
6,419,526 B1 * 7/2002 Fair ..... H01R 13/6467 439/206
6,471,551 B2 * 10/2002 Morana ..... H01R 12/716 439/541.5
6,474,999 B1 * 11/2002 Givens ..... H01R 24/64 439/38
6,511,348 B1 * 1/2003 Wojtacki ..... H01R 12/724 439/541.5
6,537,110 B1 * 3/2003 Korsunsky ..... H01R 13/6658 439/38
6,540,564 B1 * 4/2003 Ko ..... H01R 24/64 439/489
6,568,966 B1 * 5/2003 Korsunsky ..... H01R 13/6658 439/620.06
6,572,411 B1 * 6/2003 Aeschbacher ..... H01R 13/6633 439/540.1
6,585,540 B2 * 7/2003 Gutierrez ..... H01R 24/64 439/607.41
6,609,929 B2 * 8/2003 Kamarauskas ..... H01R 13/514 439/540.1
6,612,871 B1 * 9/2003 Givens ..... H01R 13/7193 439/620.17
6,623,307 B2 * 9/2003 Korsunsky ..... H01R 13/6658 439/108
6,641,440 B1 * 11/2003 Hyland ..... H01R 24/64 439/620.17
6,655,988 B1 * 12/2003 Simmons ..... H01R 13/6641 439/490
6,659,807 B1 * 12/2003 Zheng ..... H01R 24/64 439/541.5
6,663,437 B2 * 12/2003 Korsunsky ..... H01R 13/6658 439/620.06
6,699,071 B1 * 3/2004 Hyland ..... H01R 13/65802 439/607.01
6,699,077 B1 * 3/2004 Liu ..... H01R 24/64 439/676
6,702,610 B2 * 3/2004 Zheng ..... H01R 13/506 439/441
6,729,906 B1 * 5/2004 Simmons ..... H01R 13/65802 439/490
6,736,673 B1 * 5/2004 Simmons ..... H01R 24/64 439/541.5
6,739,915 B1 * 5/2004 Hyland ..... H01R 13/65802 439/676
6,743,047 B2 * 6/2004 Korsunsky ..... H01R 13/65807 439/540.1
6,761,595 B1 * 7/2004 Zheng ..... H01R 13/514 439/620.01
6,773,298 B2 * 8/2004 Gutierrez ..... H01R 13/717 439/490
6,773,302 B2 * 8/2004 Gutierrez ..... H01R 13/717 439/490
6,786,772 B1 * 9/2004 Liu ..... H01R 24/64 439/541.5
6,802,735 B2 * 10/2004 Pepe ..... H01R 24/64 439/395
6,840,817 B2 * 1/2005 Chen ..... H01R 13/65807 439/620.01
6,945,820 B1 * 9/2005 Blichasz ..... H01R 13/6658 439/620.05
6,962,511 B2 * 11/2005 Gutierrez ..... H01R 13/7172 439/490
6,976,867 B2 * 12/2005 Navarro ..... H01R 13/641 439/489
6,976,877 B2 * 12/2005 Lien ..... H01R 13/514 439/620.01
6,984,155 B1 * 1/2006 Liu ..... H01R 24/64 439/490
6,997,754 B2 * 2/2006 Wan ..... H01R 13/6461 439/541.5
7,025,635 B2 * 4/2006 Chang ..... H01R 13/719 439/620.07
7,033,210 B1 * 4/2006 Laurer ..... H01R 13/506 439/541.5
7,052,315 B2 * 5/2006 Murr ..... H01R 13/6658 439/540.1
7,074,083 B2 * 7/2006 Hyland ..... H01R 13/6658 439/607.01
7,077,707 B2 * 7/2006 Hyland ..... H01R 24/64 439/489
7,090,542 B2 * 8/2006 Zheng ..... H01R 13/514 439/676
7,121,898 B2 * 10/2006 Murr ..... H01R 24/64 439/676
7,153,158 B1 * 12/2006 Lee ..... H01R 13/6658 439/541.5
7,241,181 B2 * 7/2007 Machado ..... H01R 13/514 439/541.5
7,288,001 B1 * 10/2007 Aekins ..... H01R 4/2429 439/540.1
7,300,307 B2 * 11/2007 Murr ..... H01R 13/6658 439/540.1
7,314,387 B1 * 1/2008 Liu ..... H01R 13/6633 439/620.11
7,351,083 B2 * 4/2008 Biddle ..... H01R 13/6616 439/188
7,367,850 B1 * 5/2008 Chang ..... H01R 13/518 439/540.1
7,367,851 B2 * 5/2008 Machado ..... H01R 13/514 439/620.06
7,416,442 B1 * 8/2008 Liu ..... H01R 13/65802 439/540.1
7,510,441 B2 * 3/2009 Zhang ..... H01R 13/514 439/620.18
7,517,254 B2 * 4/2009 Zhang ..... H01R 13/6658 439/541.5
7,661,994 B2 * 2/2010 Machado ..... H01R 13/514 439/541.5
7,670,172 B2 * 3/2010 Zhang ..... H01R 24/64 439/540.1
7,670,173 B2 * 3/2010 Hu ..... H01R 13/65802 439/541.5
7,670,183 B2 * 3/2010 Huang ..... H01R 13/6633 439/620.05
7,674,136 B2 * 3/2010 Steinke ..... H01R 13/514 439/541.5
7,712,941 B2 * 5/2010 Tai ..... G02B 6/0008 362/581
7,717,749 B2 * 5/2010 Chen ..... H01R 13/6658 439/541.5
7,722,402 B2 * 5/2010 Pepe ..... H01R 13/518 439/607.18
7,736,176 B2 * 6/2010 Zhang ..... H01R 24/64 439/541.5
7,775,828 B2 * 8/2010 Zhang ..... H01R 23/6873 439/540.1
7,775,829 B2 * 8/2010 Zhang ..... H01R 13/6658 439/541.5

(56) References Cited

U.S. PATENT DOCUMENTS 7,786,009 B2 * 8/2010 Machado ..... H01R 13/514 438/676
7,819,699 B2 * 10/2010 Xu ..... H01R 13/514 439/620.09
7,837,511 B2 * 11/2010 Hsu ..... H01R 13/6658 439/490
7,845,984 B2 * 12/2010 Schaffer ..... H01R 13/514 439/620.18
7,854,624 B1 * 12/2010 Pepe ..... H01R 13/518 439/489
7,854,634 B2 * 12/2010 Filipon ..... H01R 13/6658 439/676
7,878,824 B2 * 2/2011 Pepe ..... H01R 13/40 439/607.02
7,909,619 B2 * 3/2011 Pepe ..... H01R 13/514 439/541.5
7,909,622 B2 * 3/2011 Pepe ..... H01R 13/516 439/607.02
7,909,643 B2 * 3/2011 Pepe ..... H01R 13/6658 439/540.1
7,959,473 B2 * 6/2011 Machado ..... H01R 13/514 439/541.5
8,007,318 B1 * 8/2011 Dunwoody ..... H01R 13/6461 439/607.55
8,043,112 B2 * 10/2011 Filipon ..... H01R 13/6658 439/485
8,062,049 B2 * 11/2011 Tobey ..... H01R 13/514 439/345
8,118,619 B2 * 2/2012 Schaffer ..... H01R 13/514 439/490
8,203,418 B2 * 6/2012 Harrison ..... H01F 19/04 336/192
8,206,019 B2 * 6/2012 Chen ..... G02B 6/0008 362/581
8,206,183 B2 * 6/2012 Machado ..... H01R 13/514 439/541.5
8,215,982 B2 * 7/2012 Bu ..... H01R 13/518 439/490
8,251,744 B2 * 8/2012 Huang ..... H01R 13/6658 439/607.01
8,284,007 B1 * 10/2012 Langner ..... H01F 19/04 324/117 R
8,333,599 B2 * 12/2012 Xu ..... H01R 13/6658 439/676
8,337,246 B2 * 12/2012 Zhang ..... H01R 13/6586 439/607.01
8,403,701 B2 * 3/2013 Han ..... H01R 13/6594 439/541.5
8,439,711 B2 * 5/2013 Wang ..... H01R 24/64 439/676
8,449,332 B2 * 5/2013 Purkis ..... H01R 24/64 439/620.06
8,454,382 B2 * 6/2013 Zhang ..... H01R 13/514 439/540.1
8,460,029 B1 * 6/2013 Chen ..... H01R 13/659 439/540.1
8,475,213 B2 * 7/2013 Wang ..... H01R 13/6585 439/620.05
8,480,440 B2 * 7/2013 Machado ..... H01R 13/514 439/541.5
8,529,296 B2 * 9/2013 Lee ..... H01R 13/6658 439/487
8,545,274 B2 * 10/2013 Purkis ..... H01R 13/719 439/668
8,579,660 B2 * 11/2013 Chow ..... H01R 12/724 439/540.1
8,579,661 B2 * 11/2013 Zhang ..... H01R 13/6587 439/540.1
8,591,262 B2 * 11/2013 Schaffer ..... H01F 5/003 336/170
8,636,540 B2 * 1/2014 Bu ..... H01R 13/6594 439/490
8,636,545 B2 * 1/2014 Chow ..... H01R 13/514 439/607.27
8,678,857 B2 * 3/2014 Zhang ..... H01R 13/514 439/541.5
8,684,765 B2 * 4/2014 Shirk ..... G02B 6/0008 362/551
8,869,383 B2 * 10/2014 Xu ..... H01F 17/062 29/602.1
8,882,546 B2 * 11/2014 Machado ..... H01R 13/514 439/541.5
8,888,538 B2 * 11/2014 Regnier ..... H01R 12/724 439/540.1
8,951,068 B2 * 2/2015 Tai ..... H01R 12/52 439/620.18
8,992,248 B2 * 3/2015 O'Malley ..... H01R 13/6469 439/541.5
9,054,468 B2 * 6/2015 Chang ..... H01R 13/7175
9,077,120 B2 * 7/2015 Zhang ..... H01R 13/6658
9,130,315 B2 * 9/2015 O'Malley ..... H01R 13/6469
9,136,650 B2 * 9/2015 Xuan ..... H01R 13/6633
9,136,651 B2 * 9/2015 Xuan ..... H01R 13/7175
9,147,977 B2 * 9/2015 Poulsen ..... H01R 13/6463
9,153,897 B2 * 10/2015 Chen ..... H01R 13/514
9,172,189 B2 * 10/2015 Gao ..... H01R 13/6633
9,178,318 B2 * 11/2015 Rascon ..... H01R 13/6586
9,209,581 B2 * 12/2015 O'Malley ..... H01R 13/6469
9,246,276 B2 * 1/2016 Gao ..... H01R 13/514
9,252,530 B2 * 2/2016 Zhang ..... H01R 13/514
9,257,788 B1 * 2/2016 Jia ..... G06F 1/00
2001/0000767 A1 * 5/2001 Ezawa ..... H01R 13/6691 439/490
2002/0081901 A1 * 6/2002 Ma ..... H01R 13/6485 439/607.38
2002/0160663 A1 * 10/2002 Gutierrez ..... H01R 13/717 439/676
2003/0022553 A1 * 1/2003 Chen ..... H01R 13/6658 439/540.1
2003/0087559 A1 * 5/2003 Korsunsky ..... H01R 13/6658 439/676
2003/0100225 A1 * 5/2003 Aeschbacher ..... H01R 13/6633 439/620.06
2003/0139091 A1 * 7/2003 Kamarauskas ..... H01R 13/514 439/541.5
2003/0194912 A1 * 10/2003 Ferentz ..... H01R 13/6658 439/676
2003/0207622 A1 * 11/2003 Gutierrez ..... H01R 13/717 439/676
2004/0002258 A1 * 1/2004 Zheng ..... H01R 13/506 439/541.5
2004/0132342 A1 * 7/2004 Lien ..... H01R 13/514 439/620.11
2004/0203280 A1 * 10/2004 Chang ..... H01R 13/6641 439/541.5
2004/0229501 A1 * 11/2004 Caveney ..... H01R 13/518 439/540.1
2005/0059295 A1 * 3/2005 Chen ..... H01R 13/6658 439/540.1
2005/0255746 A1 * 11/2005 Hyland ..... H01R 13/6658 439/541.5
2005/0282432 A1 * 12/2005 Murr ..... H01R 13/6658 439/540.1
2006/0030221 A1 * 2/2006 Hyland ..... H01R 24/64 439/676
2007/0155223 A1 * 7/2007 Huang ..... H01R 13/717 439/490
2007/0238359 A1 * 10/2007 Gutierrez ..... H01F 27/027 439/620.01
2007/0259573 A1 * 11/2007 Machado ..... H01R 13/514 439/676
2008/0194140 A1 * 8/2008 Zhang ..... H01R 24/64 439/540.1
2008/0220656 A1 * 9/2008 Zhang ..... H01R 24/64 439/668
2008/0233803 A1 * 9/2008 Renteria ..... H01R 13/6658 439/620.15
2008/0248684 A1 * 10/2008 Filipon ..... H01R 13/6658 439/485
2008/0305680 A1 * 12/2008 Little ..... H01R 13/514 439/541.5
2008/0305692 A1 * 12/2008 Little ..... H01R 13/6658 439/676

(56) References Cited

U.S. PATENT DOCUMENTS

2009/0098766 A1* 4/2009 Steinke ..... H01R 13/514 439/541.5
2009/0137159 A1* 5/2009 Caveney ..... H01R 29/00 439/676
2009/0149043 A1* 6/2009 Zhang ..... H01R 23/6873 439/78
2009/0243757 A1* 10/2009 Xu ..... H01R 13/6658 333/177
2009/0253293 A1* 10/2009 Zhang ..... H01R 13/6658 439/541.5
2010/0015852 A1* 1/2010 Xu ..... H01R 13/514 439/620.09
2010/0295646 A1* 11/2010 Harrison ..... H01F 19/04 336/192
2011/0053418 A1* 3/2011 Margulis ..... H01R 13/719 439/620.07
2011/0074213 A1* 3/2011 Schaffer ..... H01R 13/514 307/31
2011/0167869 A1* 7/2011 Geers ..... H01F 5/04 62/637
2011/0306241 A1* 12/2011 Zhang ..... H01R 13/6658 439/607.01
2011/0306242 A1* 12/2011 Zhang ..... H01R 13/6658 439/607.01
2011/0312212 A1* 12/2011 Machado ..... H01R 13/514 439/488
2012/0142199 A1* 6/2012 Purkis ..... H01R 24/64 439/39
2012/0176756 A1* 7/2012 Gailus ..... H01R 13/6633 361/752
2012/0196458 A1* 8/2012 Zhang ..... H01R 13/514 439/95
2012/0196478 A1* 8/2012 Zhang ..... H01R 13/514 439/607.01
2012/0196479 A1* 8/2012 Chow ..... H01R 13/514 439/607.35
2012/0309233 A1* 12/2012 O'Malley ..... H01R 13/6469 439/626
2012/0309236 A1* 12/2012 Purkis ..... H01R 24/64 439/668
2012/0315794 A1* 12/2012 Chen ..... H01R 13/514 439/620.07
2012/0322309 A1* 12/2012 Xu ..... H01F 17/062 439/620.06
2013/0017730 A1* 1/2013 Zhang ..... H01R 13/405 439/626
2013/0045643 A1* 2/2013 Hu ..... H01R 13/719 439/676
2013/0048367 A1 2/2013 Ljubijankic
2013/0102203 A1* 4/2013 O'Malley ..... H01R 13/6469 439/701
2013/0288526 A1* 10/2013 Rascon ..... H01R 13/6581 439/607.35
2014/0179163 A1* 6/2014 Zhang ..... H01R 13/6658 439/620.15
2014/0206226 A1* 7/2014 Zhang ..... H01R 13/514 439/541.5
2014/0295696 A1* 10/2014 Xuan ..... H01R 13/6633 439/488
2014/0320233 A1* 10/2014 Wei ..... H01R 13/66 333/32
2014/0322931 A1* 10/2014 Wei ..... H01R 13/6658 439/55
2014/0349519 A1* 11/2014 Gao ..... H01R 13/648 439/607.01
2014/0349525 A1* 11/2014 Gutierrez ..... H01R 13/6658 439/722
2015/0003032 A1* 1/2015 Edwards ..... H01R 13/719 361/818
2015/0024614 A1* 1/2015 Gao ..... H01R 13/514 439/78
2015/0056825 A1* 2/2015 Hsu ..... H01R 13/6587 439/78
2015/0056826 A1* 2/2015 Gao ..... H01R 13/6633 439/78
2015/0056827 A1* 2/2015 Gao ..... H01R 13/6587 439/78
2015/0325942 A1* 11/2015 Follingstad ..... H01R 13/518 439/534
2016/0064878 A1* 3/2016 Ku ..... H01R 12/716 439/78

* cited by examiner

ELECTRICAL CONNECTOR WITH PORT LIGHT INDICATOR

FIELD OF THE INVENTION

The present invention relates to an electrical connector with improved performance. In particular, the present invention improves the performance of the port light indicators, the circuit boards, and shielding.

BACKGROUND OF THE INVENTION

Cables in a server or router, for example, are typically connected to a printed circuit board by plug connectors or modules at the ends of the cables which are inserted into mating receptacles mounted on the board. These connectors are usually soldered to the PCB by wave solder or pin in paste assembly processes. In some situations however, the addition of a wave solder process for the PCB assembly is not desired, particularly if surface mount components are assembled to the bottom side of the board. In addition, electromagnetic emissions may leak from the connection between the plug connector and its mating receptacle, or between the connector shield and the panel in which it is mounted. This electromagnetic radiation can cause problems in high speed data transmissions because the emissions negatively influence signal transmissions between the connectors. It can also create interference problems with other nearby devices if internal electromagnetic emissions radiate around the connector into the external environment.

Therefore, a need exists for a printed circuit board connector with improved performance, press fit terminations, port light indication, and shielding.

SUMMARY OF THE INVENTION

Accordingly, the present invention may provide an electrical connector that includes a housing that has an interface side and a printed circuit board engagement side. At least one internal circuit board is received in the housing and at least one port is at the interface side of the housing. The port is adapted to receive a mating connector. The at least one port includes at least one signal contact connected to the internal circuit board. The signal contact is configured to mate with a corresponding contact of the mating connector. The internal circuit board has at least one terminal with a tail end that extends though the printed circuit board engagement side of the housing. At least one port light indicator is adjacent the at least one port. The at least one port light indicator has a light element facing outwardly at the interface side of the housing and a terminal end opposite the light element. At least one spring element is received in the housing. At least one spring element has a contact end and an opposite press-fit end. The contact end is biased against and in contact with the terminal end of the at least one port light indicator. The press-fit end extends through the printed circuit board engagement side of the housing. In a preferred embodiment, the light element is an LED.

The present invention may also provide an electrical connector that includes a housing that has an interface side and a printed circuit board engagement side. A plurality of ports are at the interface side of the housing. Each of the plurality of ports is adapted to receive an individual mating connector and each includes a plurality signal contacts connected to an internal circuit board. The signal contacts are configured to mate with corresponding contacts of the individual mating connectors, respectively. Each of the internal circuit boards has a plurality of terminals. Each of the terminals has a tail end that extends though the printed circuit board engagement side of the housing. A plurality of port light indicators are adjacent the plurality of ports, respectively. Each of the port light indicators has a light element facing outwardly at the interface side of the housing and a terminal end opposite the light element. A plurality of spring elements are received in the housing. Each of the plurality of spring elements has a contact end and an opposite press-fit end. Each of the contact ends is biased against and in contact with one of the terminal ends of the plurality of port light indicators. The press-fit ends extend through the printed circuit board engagement side of the housing.

Other objects, advantages and salient features of the invention will become apparent from the following detailed description, which, taken in conjunction with the annexed drawings, discloses a preferred embodiment of the present invention.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Referring to FIGS. 1-6, the present invention provides an electrical connector 100 that is designed to be connected to a main printed circuit board 102 and receive one or more mating connectors 104. In a preferred embodiment, the electrical connector is an RJ series type connector in a 2×2 configuration that receives RJ series plugs.

Figure 1:
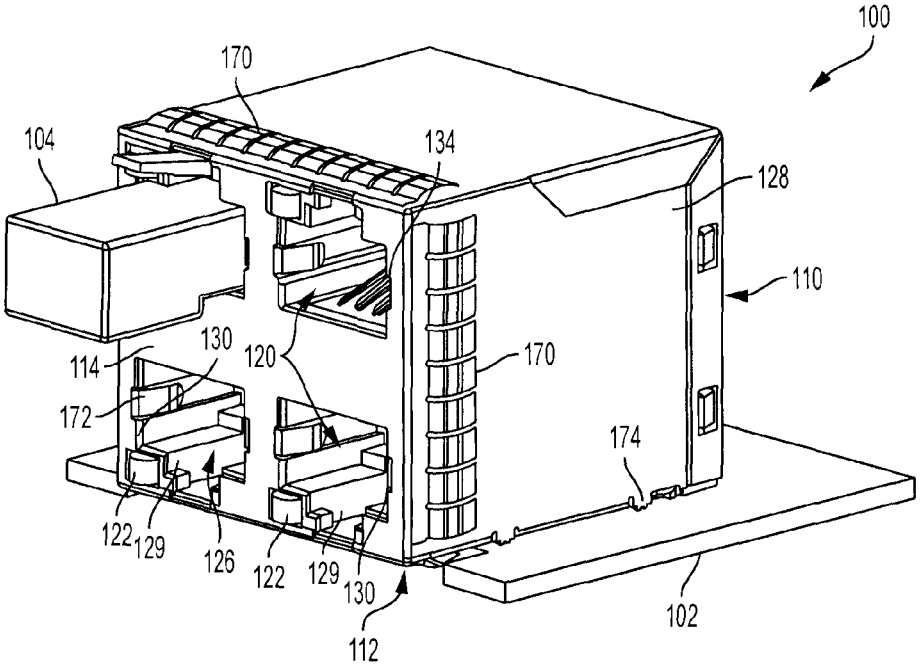
FIG. 1 is a perspective view of an electrical connector according to an exemplary embodiment of the present invention, showing a mating component being inserted into the connector.

As seen in FIG. 1, the connector 100 generally includes a housing 110 that has at least one side 112 that engages the main printed circuit board 102 and another side 114 that interfaces with the mating connectors 104. Built into the housing 110 are one or more connector ports 120 that individually receive the mating plugs 104. The ports 120 include light indicators 122 that when illuminated signify that the connector is positively electrically connected to the main printed circuit board 102 and ready to receive the mating plugs. The port light indicators 120 are configured to provide flexibility and tolerance with respect to the mechanical connection to the main printed circuit board 102 to avoid damage to the indicators while also reducing costs.

Figure 2:
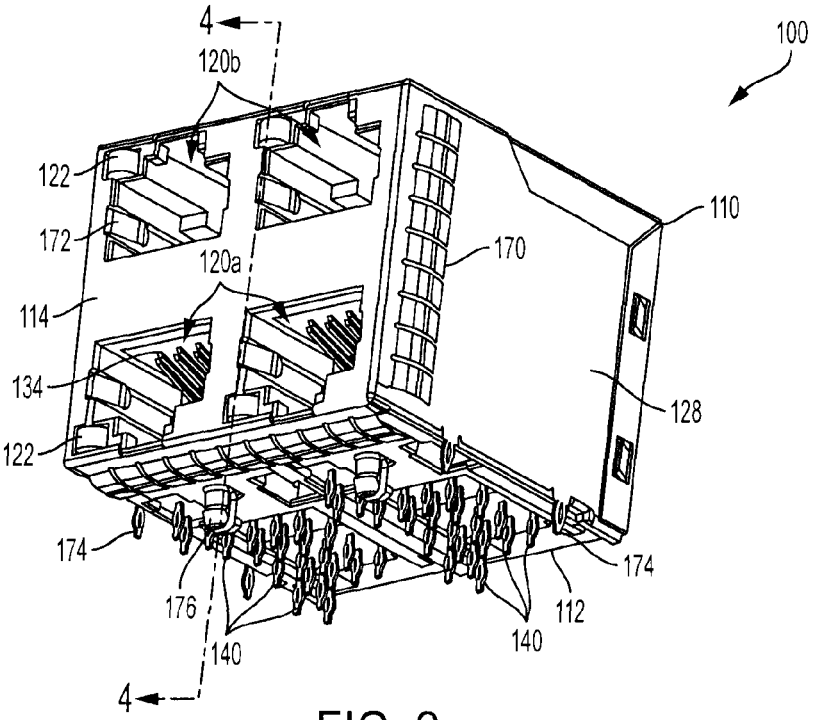
FIG. 2 is a bottom perspective view of the electrical connector illustrated in FIG. 1.
Figure 3:
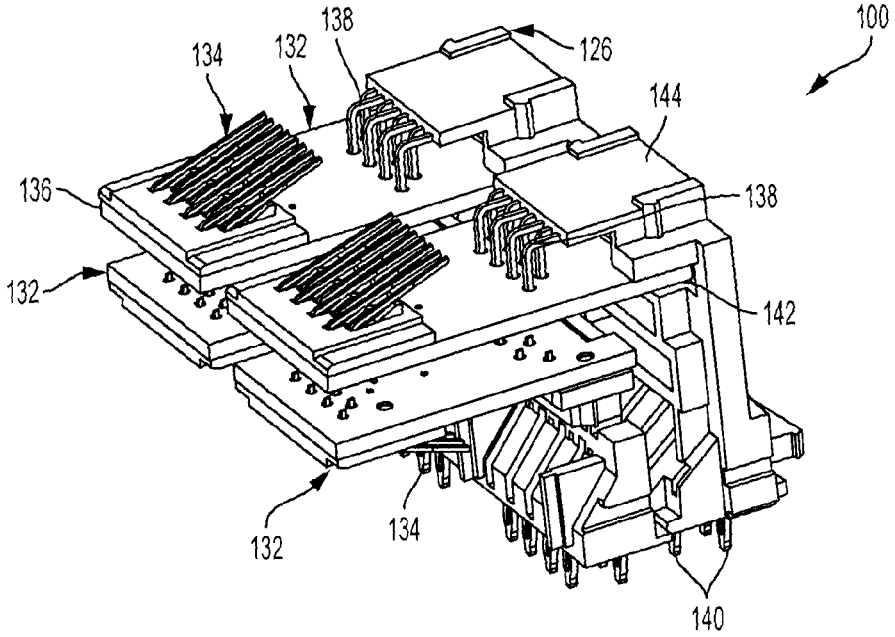
FIG. 3 is a perspective end view of the electrical connector illustrated in FIG. 1, showing the connector with its housing removed.

The housing 110 includes a frame 126 with an outer conductive shell 128 surrounding the frame 126. The connector ports 120 are formed in the frame 126 such that the access openings 130 of the ports 120 are at the interface side 114 of the housing 110, as seen in FIGS. 1 and 2. The inner receiving area of each port 120 is preferably shaped to accept a standard RJ plug. However, the ports 120 may be shaped to receive various types of plugs, as desired. The housing 110 also includes a plurality of internal circuit boards associated 132 with each of its ports 120. Each internal circuit board 132 includes one or more signal contacts 134 that correspond to the signal contacts of the mating plug 104. The signal contacts 134 may be formed as spring members extending from near one end 136 of the board 132, as seen in FIG. 3. In a preferred embodiment, the internal circuit boards 132 include eight signal contacts 134 to match those of the RJ series mating plug 104. Each internal circuit board 132 also includes one or more terminals 138 associated with each of the signal contacts 132 and connectable to the main printed circuit board 102 at their tails ends 140. The terminals 138 connect to the boards 132 near a second end 142 thereof remote from the first end 136. The circuitry of each internal circuit board 132 is such that capacitance is improved to meet CAT5e performance. The capacitance may be induced by the shape and form of the signal traces which are placed in close proximity to each other on the PCB. The internal circuit boards 132 are supported in a cantilever fashion by a rear portion 144 of the frame 126 of the housing 110, as best seen in FIG. 3, such that the signal contacts 134 are near the interface side 114 (FIG. 1) of the housing 110 and exposed in the respective ports 120 to connect to the corresponding contacts of the mating plug. The terminals 138 extend through the rear portion 144 of the housing frame 126 and through the printed circuit board mating side 112 of the housing. The tail ends 140 (FIG. 2) of the terminals 138 are preferably eye-of-the-needle (EON) type that may be press-fit into the main printed circuit board 102.

In a preferred embodiment, the ports 120 of the housing 110 are arranged in 2×2 configuration, as seen in FIGS. 1 and 2. In such a configuration, the internal circuit boards 132 are oriented between a first group of two ports 120*a* (FIG. 2) and a second group of two ports 120*b* (FIG. 2). The internal circuit boards 132 are also oriented such that the signal contacts 134 for the first group of ports 120*a* face away from the signal contacts 134 for the second group of ports 120*b*. For example, the groups of ports 120*a* and 120*b* may be stacked one on top of the other such that the first group of ports 120*a* define lower ports and the second group of ports 120*b* define upper ports, as shown in FIG. 2. In that case, the printed circuit board engagement and interface sides 112 and 114 are generally perpendicular to one another, two of the internal circuit boards 132 face downwardly into the lower ports 120*a*, and the other two internal circuit boards 132 face upwardly into the upper ports 120*b*. Also, in that case, the terminals 138 of the two internal circuit boards 132 for the upper ports 120*b* are be longer than the terminals 138 of the two boards for the lower ports 120*a* in order to reach the main printed circuit board 102. Alternatively, the two groups of ports 120*a* and 120*b* may be side-by-side instead of stacked one on top of another. In that case, the printed circuit board engagement and interface sides 112 and 114 would be generally parallel, the internal circuit boards 132 would be oriented vertically rather than horizontally, and the first group of portions 120*a* would be located between the printed circuit board side 112 of the housing and the second group of ports 120*b*.

The port light indicators 122 when illuminated give a visual indication that the housing 110, and particularly the ports 120, are electrically coupled to the printed circuit board 102. Thus when illuminated, one or more of the mating plugs 104 (FIG. 1) can be electrically connected to the main printed circuit board 102. In particular, when one of the mating plugs 104 is inserted into one of the ports 120, the mating plug 104 is electrically connected to the main printed circuit board 102 via the signal contacts 134 of the internal circuit boards 132 engaging the mating plug's contacts, the internal circuit board 132 electrically coupling the signal contacts 134 with the terminals 138, and the terminals 138 coupling with the printed circuit board 102 by the press-fit tails 140.

Figure 4:
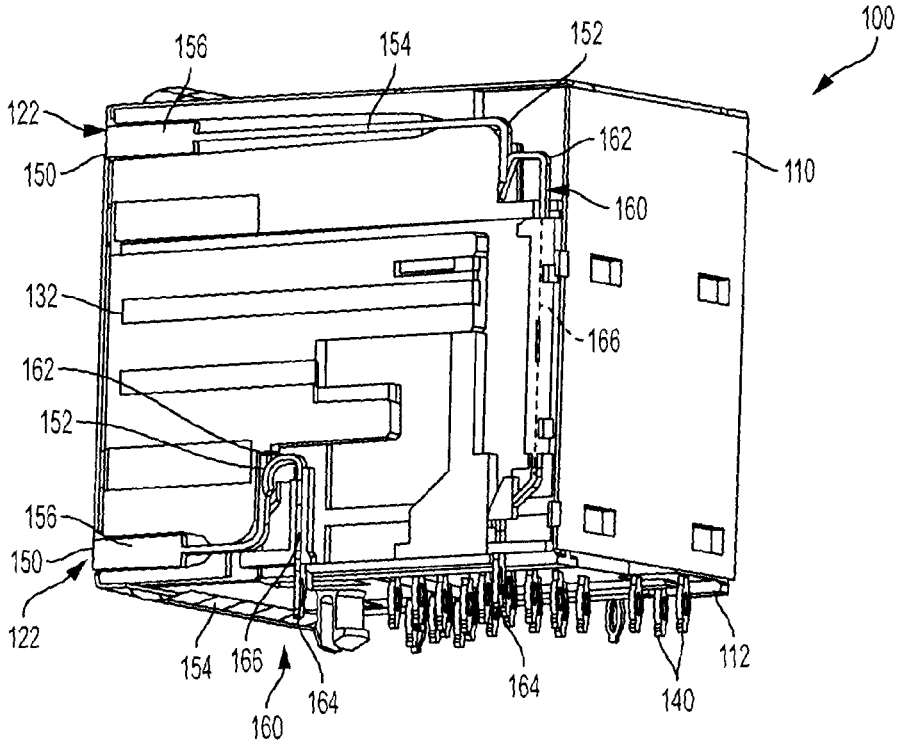
FIG. 4 is a perspective cross-sectional view of the electrical connector taken along line 4-4 of FIG. 2, showing port light indicators and associated insert springs.

Each port 120 preferably has at least one port light indicator 122. The port light indicators 122 are positioned to face outwardly from the interface side 114 of the housing 110. The port light indicator 122 may be positioned adjacent the respective port 120, that is either directly next to or close by the port 120. In a preferred embodiment, the housing frame 126 includes a receiving area 129 designed to accommodate the indicator 122 adjacent the port 120. Each light indicator 122 is electrically coupled to the main printed circuit board 102 by a spring insert 160. Each light indicator 122 includes a light element end 150 and an opposite terminal end 152 with an extension portion 154 therebetween. The light element end 150 includes a light element 156, such as an LED. Each spring insert 160 includes first and second opposite ends 162 and 164 with an intermediate body portion 166 therebetween. The first end 162 is preferably biased against the terminal end 152 of the port light indicator 122. The first end 162 may be shaped as a rounded hook, as seen in FIG. 4, or have a gull wing profile. The second end 164 extends through the printed circuit board engagement side 112 of the housing 110. The second end 164 preferably includes an eye-of-the-needle (EON) configuration for press-fitting into the main printed circuit board 102. Because of the spring nature of the inserts 160, flexibility and tolerance is provided such that slight movement of the housing 110 can be tolerated while the port light indicators 122 remain illuminated. Moreover, the flexible nature of the spring inserts 160 along with the press-fit engagement of its ends 164 with the printed circuit board 102 reduce the chance of damage that may be done to the port light indicator 122 because it is connected to the board 104. That also allows the material of the press fit ends to be different than the steel lead frame of the lighting side. For example, that allows the use of a material with good spring properties for the EON ends.

Figure 5:
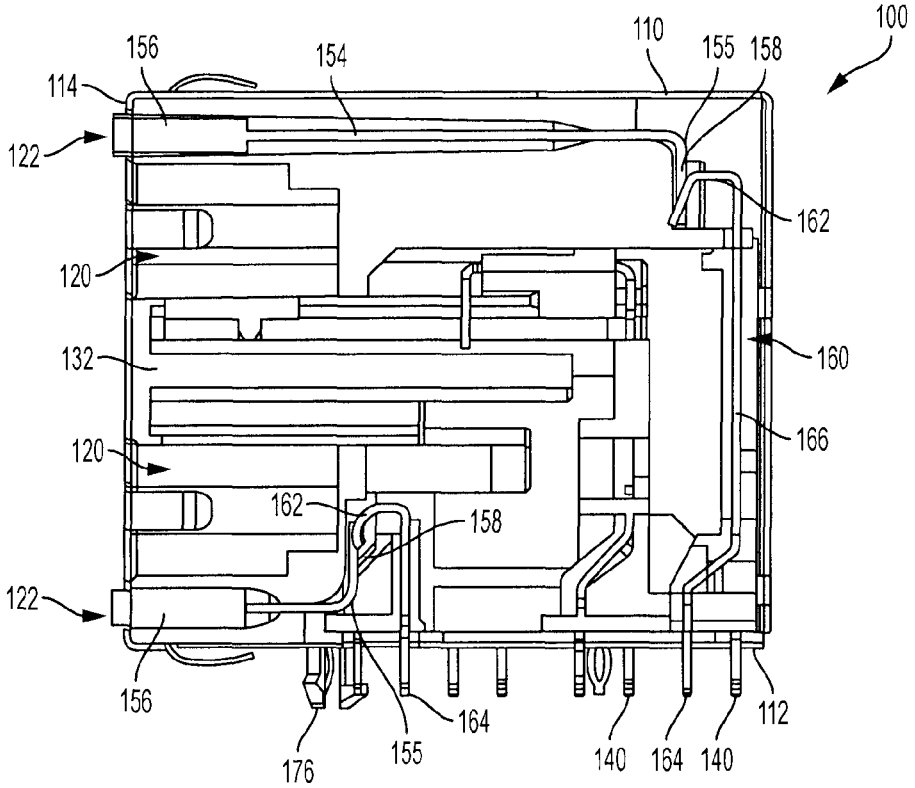
FIG. 5 is a side cross-sectional elevational view of the electrical connector similar to FIG. 4.

In the exemplary embodiment of the connector being arranged with lower and upper ports 120*a* and 120*b*, the intermediate body portion 166 of the spring insert 160 for the upper ports 120*b* will be longer the intermediate body portion 166 of the spring insert 160 for the lower ports 120*a* in order for the second end 164 to reach the main printed circuit board. Moreover, the terminal ends 152 of the port light indicators 122 may include a right hand bend 155 (FIG. 5) in order to provide a contact area 158 for engaging the contact ends 162 of the spring inserts 160, as seen in FIGS. 4 and 5. The contact areas 158 (FIG. 5) generally face the rear of the housing 110 away from housing interface side 114. The terminals ends 152 of the port light indicators 122 for the lower ports 120*a* extend upwardly and the terminal ends 152 of the port light indicators 122 of the upper ports 120*b* extend downwardly.

EMI spring fingers 170 may be provided at the interface side 114 of the housing for improved shielding. In particular, a strip of the spring fingers 170 may be disposed on the shell 128 at each of the end edges of the housing interface side 114, as seen in FIGS. 1 and 2. A spring arm 172 may be provided in each port 120 to help retain the mating plug 104 therein. The outer shell 128 may include alignment pins 174 at the print circuit board engaging side 112 of the housing 112 to facilitate location of the housing 110 on the main printed circuit board 102. Locking members 176 may also be provided at the printed circuit board engagement side 112 of the housing 110 that interlock with the printed circuit board 102.

Figure 6:
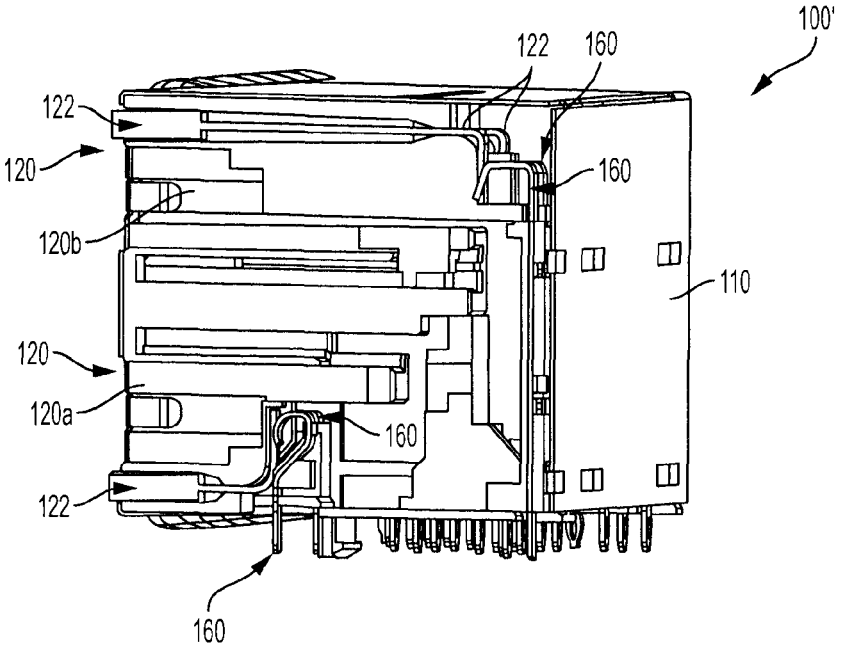
FIG. 6 is a perspective cross-sectional view similar to FIG. 4, showing an alternative exemplary embodiment of the present invention.

FIG. 6 illustrates another exemplary embodiment of the present invention in which the electrical connector 100' is substantially the same as the connector 100, except that it includes multiple port light indicators 122 for each port 120. As seen in FIG. 6, a plurality of insert springs 160 are provided that engage respective port light indicators 122 of the first set of ports 120*a* and the second set of ports 120*b*. The port light indicators 122 are preferably adjacent one another, as seen in FIG. 6; however, the port light indicators 122 may be spaced from one another, such as being located at opposite corners of a respective port 120.

While a particular embodiment has been chosen to illustrate the invention, it will be understood by those skilled in the art that various changes and modifications can be made therein without departing from the scope of the invention as defined in the appended claims. For example, any number of ports 120, including only one port 120, may be provided, along with any number of associated port light indicators 122. Also, the ports 120 may be arranged in any fashion, such as stacked or side-by-side.

What is claimed is:

1. An electrical connector, comprising:

a housing having an interface side and a printed circuit board engagement side;

at least one internal circuit board received in said housing;

at least one port at said interface side of said housing, said port being adapted to receive a mating connector, said at least one port including at least one signal contact connected to said internal circuit board, said signal contact being configured to mate with a corresponding contact of the mating connector, said internal circuit board having at least one terminal with a tail end extending though said printed circuit board engagement side of said housing;

at least one port light indicator adjacent said at least one port, said at least one port light indicator having a light element facing outwardly at said interface side of said housing and a terminal end opposite said light element; and at least one spring element received in said housing, said at least one spring element having a contact end and an opposite press-fit end, said contact end being biased against and in contact with said terminal end of said at least one port light indicator, and said press-fit end extending through said printed circuit board engagement side of said housing.

2. An electrical connector according to claim 1, wherein said light element is an LED.

3. An electrical connector according to claim 1, further comprising a second port light indicator adjacent said at least one port, said second port light indicator having a light element facing outwardly at said interface side of said housing and a terminal end opposite said light element; and a second spring element having a contact end being biased against and in contact with a contact area of said terminal end of said second port light indicator.

4. An electrical connector according to claim 3, wherein said second spring element is longer than said at least one spring element.

5. An electrical connector according to claim 3, wherein each of said contact ends of said spring elements having a hook shape.

6. An electrical connector according to claim 1, further comprising a second port at said interface side of said housing, said second port being adapted to receive a mating connector, said second port including at least one signal contact connected to a second internal circuit board, said signal contact being configured to mate with a corresponding contact of the mating connector, said second internal circuit board having at least one terminal with a tail end extending though the printed circuit board engagement side of said housing, and said first port being between said printed circuit board side of said housing and second port.

7. An electrical connector according to claim 1, wherein said at least one port includes a plurality of signal contacts connected to said internal circuit board; and said internal circuit board having a plurality of terminals extending through said printed circuit board engagement side of said housing, said plurality of terminals corresponding to said plurality of signal contacts.

8. An electrical connector according to claim 1, wherein said housing includes an outer conductive shell, said shell including at least one printed circuit board alignment pin.

9. An electrical connector according to claim 8, further comprising a plurality of EMI spring fingers disposed on said shell at said interface side of said housing.

10. An electrical connector according to claim 1, wherein said tail end of said terminal is an eye-of-the-needle press-fit end.

11. An electrical connector according to claim 1, wherein said terminal end of said at least port light indicator includes a bend that defines a contact area for contact said contact end of said at least one spring insert.

12. An electrical connector, comprising:

a housing having an interface side and a printed circuit board engagement side;

a plurality of ports at said interface side of said housing, each of said plurality of ports being adapted to receive an individual mating connector, each of said plurality of ports including a plurality signal contacts connected to an internal circuit board, said signal contacts being configured to mate with corresponding contacts of the individual mating connectors, respectively, each of said internal circuit boards having a plurality of terminals, each of said terminals having a tail end extending though the printed circuit board engagement side of said housing;

a plurality of port light indicators adjacent said plurality of ports, respectively, each of said port light indicators having a light element facing outwardly at said interface side of said housing and a terminal end opposite said light element; and a plurality of spring elements received in said housing, each of said plurality of spring elements having a contact end and an opposite press-fit end, each of said contact ends being biased against and in contact with one of said terminal ends of said plurality of port light indicators, and said press-fit ends extending through said printed circuit board engagement side of said housing.

13. An electrical connector according to claim 12, wherein said plurality of ports include a first group of lower ports and a second group of upper ports, and said internal circuit boards dividing said lower ports and said upper ports.

14. An electrical connector according to claim 12, wherein each of said plurality of ports includes more than one of said port light indicators.

15. An electrical connector according to claim 12, wherein each is said light elements is an LED.

16. An electrical connector according to claim 12, wherein at least one of said plurality of spring elements is longer than another one of said plurality of spring elements.

17. An electrical connector according to claim 12, wherein each of said contact ends of said spring elements having a hook shape.

18. An electrical connector according to claim 12, wherein each of said tail ends of said terminal is an eye-of-the-needle press-fit end.

19. An electrical connector according to claim 12, wherein each of said press-fit ends of said spring inserts is an eye-of-the-needle press-fit end.

20. An electrical connector according to claim 12, wherein the mating connector is an RJ series plug.

* * * * *